US007617862B2

(12) United States Patent
Guttenbrunner et al.

(10) Patent No.: US 7,617,862 B2
(45) Date of Patent: Nov. 17, 2009

(54) STRAND-GUIDING ROLLER

(75) Inventors: Josef Guttenbrunner, Sierning (AT); Thomas Starrermair, Dietach (AT); Günther Deibl, Leonding (AT)

(73) Assignee: Siemens Vai Metals Technologies GmbH & Co. (AT)

( * ) Notice: Subject to any disclaimer, the term of this patent is extended or adjusted under 35 U.S.C. 154(b) by 277 days.

(21) Appl. No.: 10/552,212

(22) PCT Filed: Apr. 8, 2004

(86) PCT No.: PCT/EP2004/003770

§ 371 (c)(1),
(2), (4) Date: Nov. 1, 2005

(87) PCT Pub. No.: WO2004/094087

PCT Pub. Date: Nov. 4, 2004

(65) Prior Publication Data

US 2006/0260781 A1 Nov. 23, 2006

(30) Foreign Application Priority Data

Apr. 23, 2003 (AT) ..... A 615/2003

(51) Int. Cl.
*B22D 11/124* (2006.01)
*B22D 11/128* (2006.01)

(52) U.S. Cl. ..... 164/448; 164/442

(58) Field of Classification Search ..... 164/448, 164/442, 428, 480
See application file for complete search history.

(56) References Cited

U.S. PATENT DOCUMENTS

| | | | | |
|---|---|---|---|---|
| 4,137,963 A | | 2/1979 | Langer et al. | 164/448 |
| 4,164,252 A | * | 8/1979 | Scheurecker | 164/448 |
| 4,351,383 A | | 9/1982 | Gladwin | 164/448 |
| 5,209,283 A | | 5/1993 | Miltzow et al. | 164/448 |
| 5,638,891 A | * | 6/1997 | Fukase et al. | 164/448 |
| 7,165,891 B2 | * | 1/2007 | Giertz | 384/418 |
| 2004/0035549 A1 | * | 2/2004 | Eberwein | 164/428 |

FOREIGN PATENT DOCUMENTS

| | | |
|---|---|---|
| DE | 25 52 969 | 9/1977 |
| DE | 29 35 217 A1 | 3/1981 |
| DE | 197 44 077 A1 | 4/1999 |
| JP | 49-110012 | 9/1974 |
| JP | 50-11934 | 5/1975 |

(Continued)

OTHER PUBLICATIONS

International Search Report PCT/EP2004/003770 dated Aug. 24, 2004.

*Primary Examiner*—Kevin P Kerns
(74) *Attorney, Agent, or Firm*—Ostrolenk Faber LLP

(57) ABSTRACT

A strand-guiding roll for supporting and guiding cast metal strands in a continuous casting installation, having a central rotatable shaft and having at least one roll shell supported fixed against rotation on this shaft. To enable the strand-guiding roll to cope with the mechanical and thermal stresses, the roll shell is supported by support rings or by a support-ring sleeve on the shaft. An annular space, which is axially delimited by the support rings for the shell, is formed between the shaft and the roll shell. The annular space is a coolant conduit.

7 Claims, 2 Drawing Sheets

FOREIGN PATENT DOCUMENTS

| | | |
|---|---|---|
| JP | 53-47330 | 4/1978 |
| JP | 59-232657 | 12/1984 |
| JP | 62-199245 | 12/1987 |
| JP | 63-150744 | 10/1988 |
| JP | 9-42462 | 2/1997 |
| WO | WO 93/19874 | 10/1993 |
| WO | WO 02/38972 A1 | 5/2002 |

* cited by examiner

STRAND-GUIDING ROLLER

CROSS REFERENCE TO RELATED APPLICATION

The present application is a 35 U.S.C. 371 national phase conversion of PCT/EP2004/003770, filed 8 Apr. 2004, which claims priority of German Application No. A 615/2003, filed 23 Apr. 2003. The PCT International Application was published in the German language.

BACKGROUND OF THE INVENTION

The invention relates to a strand-guiding roll for supporting and guiding cast metal strands in a continuous casting installation, having a central rotatable shaft and having at least one roll shell supported fixed against rotation on this shaft.

Strand-guiding rolls are used in continuous casting installations to support and guide continuously cast metal strands after they emerge from a mold in a strand-guiding stand. They are exposed to high thermal stresses, since the cast metal strands leave the mold at a temperature of over 1000° C. if they are steel strands for example. In the case of relatively thick strands, there is still a pronounced liquid core in the strand, as a result of which ferrostatic forces act on the strand-guiding rolls. In addition, the strand-guiding rolls have to withstand deformation forces from the strand bending. Accordingly, the strand-guiding rolls are usually equipped with internal cooling and are of a robust design suitable for the mechanical stresses. The considerable width of the cast strands requires multiple mounting of the strand-guiding roll and accordingly a multi-part structure.

In conventional continuous casting installations, two basic types of strand-guiding rolls, which differ in terms of their basic structure, are used.

One basic type of strand-guiding rolls comprises a stationary central axle, on which one or more roll shells are rotatably supported by way of sliding or rolling bearing arrangements. Strand-guiding rolls of this type are already known, for example, from DE-A 197 44 077, DE-A 27 45 578, DE-A 38 23 655 and U.S. Pat. No. 4,351,383. On account of the relative movement between individual components of the strand-guiding rolls, it is necessary to provide bearing arrangements which are exposed to thermal stresses and accordingly require protective measures.

A further basic type of strand-guiding rolls avoids the need for bearing arrangements of this type within the rolls and comprises a central rotatable shaft and roll shells mounted fixedly in terms of rotation thereon. An outline representation of a strand-guiding roll of this type is to be found in DE-A 29 35 217.

DE-A 25 52 969 has disclosed a further strand-guiding roll with a multiply mounted continuous shaft, on which individual roll sections are arranged fixed in terms of rotation by a welded joint. An annular space as coolant conduit is formed between the central shaft and the roll sections and is connected to central supply lines. This welded design means that the strand-guiding roll cannot be dismantled, and therefore the roll sections, which are subjected to high thermal and mechanical stresses, cannot be replaced.

WO 93/19874 has disclosed a strand-guiding roll, the roll bodies of which are formed substantially as a single piece. However, it is very complex and expensive to produce the coolant lines passing through the roll body.

WO 02/38972 A1, based on FIGS. 1*a* and 1*b*, reports a prior art which involves a strand-guiding roll with a central, multiply mounted shaft and a plurality of roll shells arranged thereon. The entire inner surface of each roll shell bears against the outer surface of the shaft, and is connected to it fixed against rotation by way of a feather key. This strand-guiding roll is internally cooled via a coolant line which runs centrally within the shaft. A strand-guiding roll of this type has the fundamental drawback of a long heat-transfer path from the shell surface to the coolant line. Gaps between the shaft and the roll shell act as an insulator and additionally impede the dissipation of heat from the strand-guiding roll.

Furthermore WO 02/38972 A1 has disclosed a strand-guiding roll with a multiply mounted shaft and roll shells fitted onto it, each roll shell being arranged fixed against rotation on the shaft by means of a feather key. An annular space, which is filled with a material with a high thermal conductivity, is provided between the roll shell and the shaft over part of the longitudinal extent of the roll shell. The dissipation of heat from the strand-guiding roll is effected by internal cooling via a central coolant line which passes through the shaft. Although the thermally conductive filler avoids the barrier action of an air gap between the roll shell and the shaft, the considerable distance between the thermally stressed roll shell surface and the coolant line nevertheless still exists.

Therefore, it is an object of the present invention to avoid the drawbacks of the known prior art and to propose a strand-guiding roll which is able to better cope with the mechanical and thermal stresses which occur as a result of the strand. In particular, the way in which the roll shell is supported on the shaft is to be able to better match the stresses which occur.

SUMMARY OF THE INVENTION

In a strand-guiding roll of the type according to the invention, this object is achieved by virtue of the fact that the roll shell is supported via support rings on the shaft, that an annular space which is axially delimited by the support rings is formed between the shaft and the roll shell, and the annular space is designed as a coolant conduit.

Forming the support rings as independent components and arranging them in the edge regions of each roll shell means that forces are introduced into the shaft in the region close to the supporting roll bearings. Peak thermal and mechanical loads caused by deformation and wear are avoided. At the same time, corresponding steps in the shaft diameter at the contact surfaces with the support rings allow simple assembly and dismantling of the strand-guiding roll for maintenance work and for replacing a roll shell.

Forming an annular space, which is axially delimited by the support rings, between the shaft and the roll shell creates regions which are separate from one another, on the one hand for dissipating forces and on the other hand for dissipating heat from the roll shell, and precludes disruptive interaction.

To avoid leaks at the annular space, sealing elements, preferably sealing rings inserted in annular grooves, are arranged between the support rings and the roll shell and between the support rings and the central shaft.

The annular space is designed as a coolant conduit, which is connected to a coolant line arranged in the central shaft via radial branch lines for supplying and discharging a coolant. The radial branch lines open out within the longitudinal extent of the support rings into an annular groove in the support ring which is open toward the annular space via a multiplicity of outlet openings.

An advantageous configuration consists in providing a plurality of radial branch lines distributed over the cross section of the shaft, both in a coolant feed plane and in a coolant discharge plane, so that an axial flow of coolant which is as uniform as possible is achieved over the entire circumference of the annular space. In addition, diverting devices, which make the axial flow profile in the annular space even more uniform, may be installed in the annular space. Accordingly, the radial branch lines open out within the longitudinal extent of the support rings into an annular groove in the support ring which is open toward the annular space via a multiplicity of outlet openings.

The roll shell is secured against rotation with respect to the shaft by a rotation-preventing means, preferably a feather key, and the rotation-preventing means in this case passes through the annular space. Arranging the rotation-preventing means within the annular space between the two support rings means that the flow conditions for the coolant are scarcely impaired. However, sealing problems, which arise if the rotation-preventing means is arranged at a supporting surface of the roll shell on the shaft, as is the case in the strand-guiding roll described in WO 02/38972 A1, are avoided.

According to a further possible embodiment of the strand-guiding roll according to the invention, two support rings, which support a roll shell on the shaft, are connected to form a support-ring sleeve, and an annular space, the axial extent of which is delimited by the support rings, is formed between the roll shell and the support-ring sleeve. Sealing elements and coolant conduits are designed analogously to the embodiment described above. The rotation-preventing means passes through the annular space and the support-ring sleeve.

One possible configuration of the passage of coolant through the strand-guiding roll consists in the fact that the coolant line which runs within the central shaft starts from one end side of the central shaft, and the coolant line for discharging coolant arranged in the central shaft opens out at the opposite end side of the central shaft, and each coolant line is assigned a rotary connection piece.

One advantageous embodiment, which allows the supply of coolant to the strand-guiding rolls to be restricted to one side of the installation or side of the strand guidance, consists in the fact that the coolant lines which run within the central shaft open out in one end side of the central shaft, and these coolant lines are assigned a multiple rotary connection piece. This embodiment can be used for both driven and undriven strand-guiding rolls.

The coolant used is usually cooling water.

Further features and advantages of the present invention will emerge from the following description of a non-restricting exemplary embodiment, in which reference is made to the appended figures, in which:

The illustrations in the figures show a strand-guiding roll according to the invention in the form of a diagrammatic illustration, as is suitable, for example, for use in a strand-guiding section of a continuous casting installation for producing metal strands of a considerable width, with a slab or thin slab cross section.

DESCRIPTION OF THE PREFERRED EMBODIMENTS

Figure 1:
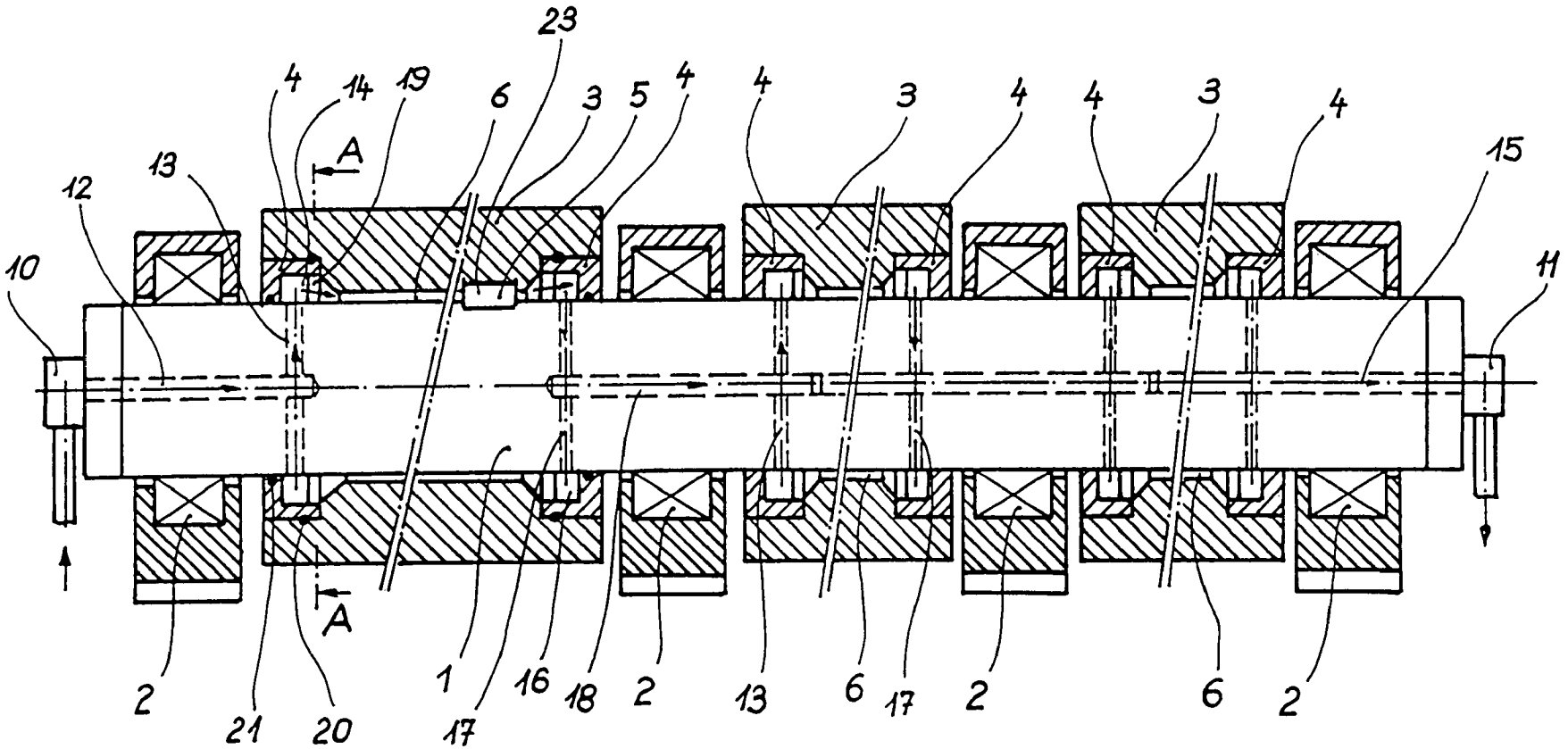
FIG. 1 shows a longitudinal section through a strand-guiding roll according to the invention.

The strand-guiding roll illustrated in FIG. 1 comprises a central shaft 1, which is supported rotatably in four bearings 2. The bearings and the bearing housings which support them are in turn supported in a strand-guiding stand (not shown) of a continuous casting installation.

The bearings used are usually rolling-contact bearings. The central shaft 1 is assigned three roll shells 3, each of the three roll shells being supported on the shaft 1 by way of, in each case, two support rings 4. The bearings 2 are located outside the longitudinal extent of the adjacent roll shells 3. A rotation-preventing means 5 rotationally fixes the position of each roll shell 3 with respect to the shaft 1. An annular space 6, which forms a coolant conduit, is provided between the support rings 4 of a roll shell 3, the inner lateral surface of the roll shell and the outer lateral surface of the shaft 1. Strand-guiding rolls of the type according to the invention have at least two, and usually three, roll shells.

The strand-guiding roll is equipped with internal cooling. The passage of the flow of coolant is indicated by arrows in FIG. 1. The coolant supply takes place on one end side of the strand-guiding roll via a rotary connection piece 10, and the discharge of coolant takes place at the opposite end side of the strand-guiding roll via a rotary connection piece 11. The coolant is introduced into the annular space 6 through a central coolant line 12, radial branch lines 13 which branch off from it and an annular groove 14 in the support ring 4 with axially oriented outlet openings 19. The coolant, distributed over the entire cross section of the annular space 6, flows through the annular space 6 parallel to the longitudinal axis 15 of the strand-guiding roll and is collected again in an annular groove 16 in the support ring 4 and discharged through radial branch lines 17 into the central coolant line 18. The coolant line 18 either leads to further branch lines 13 of a further roll shell 3 or, after it has passed through all the roll shells 3, to the discharging rotary connection piece 11, through which the coolant leaves the strand-guiding roll again. To ensure that no coolant emerges from the annular space, a sealing element 20 is fitted between the support ring 4 and the roll shell 3 and a sealing element 21 is fitted between the roll shell 3 and the shaft 1. The sealing elements are formed by sealing rings inserted into annular grooves.

However, the supply of coolant and the discharge of coolant through the central coolant lines may also take place on just one side, i.e. one end side of the central shaft, via a double rotary connection piece, with the result that the provision of coolant is restricted to one side of the strand-guiding arrangement and therefore one side of a continuous casting installation.

In the case of a driven strand-guiding roll, the central coolant lines for the supply and discharge of coolant, starting from one end side of the strand-guiding roll, are inevitably guided parallel to the longitudinal axis of the shaft, since the roll drive is assigned to the opposite end side. Accordingly, the attached rotary connection piece is equipped with two coolant connections.

Figure 2:
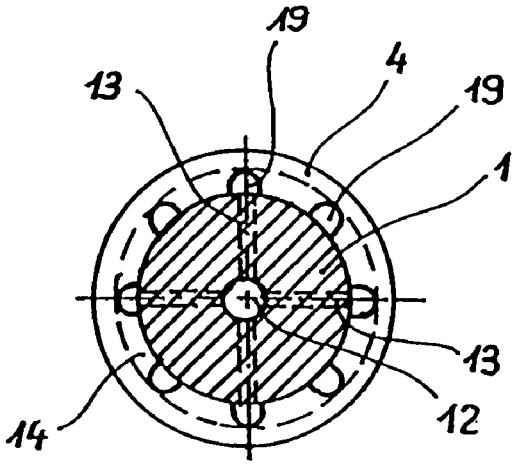
FIG. 2 shows a cross section through the strand-guiding roll on line A-A in FIG. 1.

FIG. 2 shows, in the form of a cross section of the shaft 1 on section line A-A in FIG. 1, an end view of the support ring 4 illustrating the passage of coolant in this region. The coolant is introduced from the central coolant line 12 via the branch lines 13 into an encircling annular groove 14 in the support ring 4, where it is distributed and passed through a multiplicity of outlet openings 19 which are distributed over the circumference and may be designed as grooves or bores, to the annular space 6 between roll shell 3 and shaft 1, illustrated in FIG. 1. The reverse sequence is produced when the coolant is being discharged from the annular space 6.

This type of coolant routing allows heat to be dissipated from the roll shell as uniformly and efficiently as possible with little manufacturing technology.

The rotation-preventing means 5 for securing the position of the roll shell 3 on the shaft 1 is formed by one or more feather keys 23, which pass through the annular space 6 and are arranged between two support rings 4 which support a roll shell 3. In the region of the annular space 6 there is sufficient space for a long feather key 23, so that circumferential forces or torques which act on the roll shell can be supported with little surface pressure on the shaft, in particular in the case of driven strand-guiding rolls.

Figure 3:
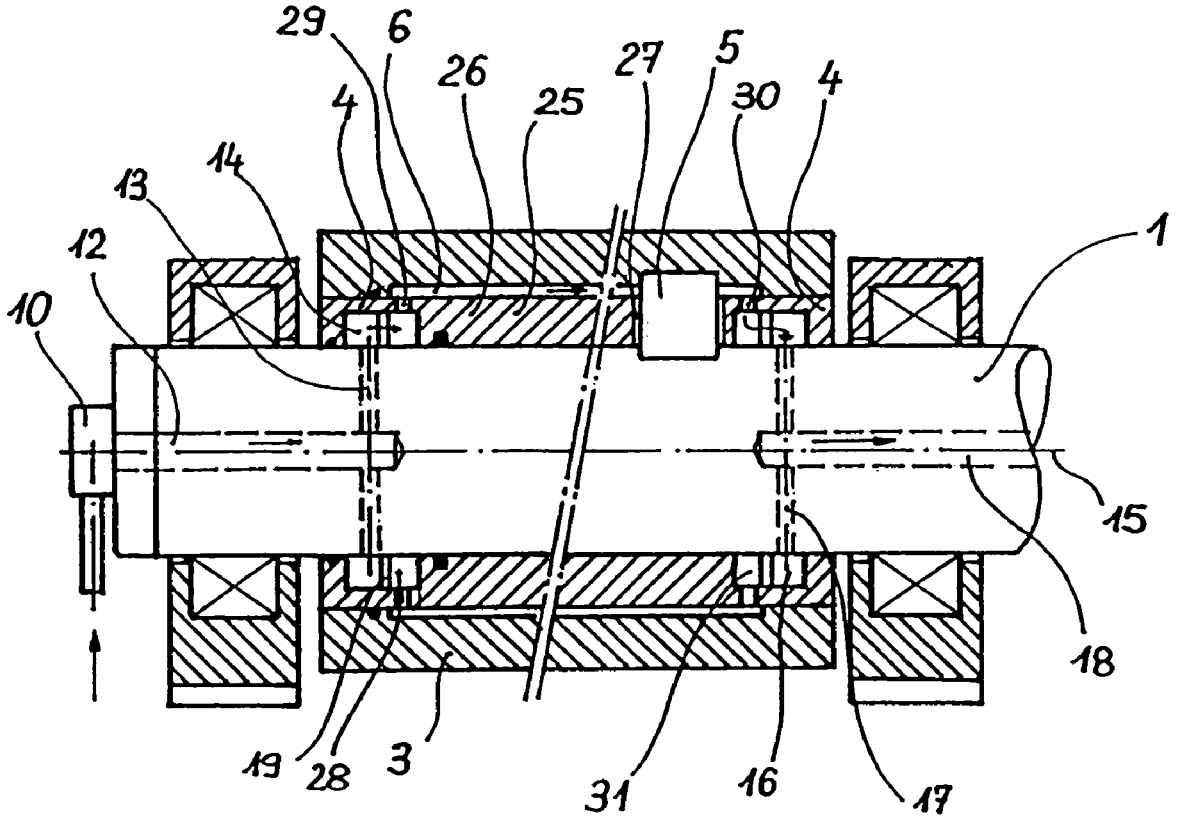
FIG. 3 shows a further embodiment of the strand-guiding roll according to the invention in longitudinal section through a roll section.

A further embodiment of the strand-guiding roll according to the invention is illustrated in FIG. 3 in the form of a longitudinal section through part of the strand-guiding roll, in which identical reference designations are used for identical or equivalent components.

The roll shell 3 is supported via support rings 4 on the central shaft 1, with the two support rings 4 arranged at the edge regions of the roll shell being connected by a sleeve 25 to form a support-ring sleeve 26. The support-ring sleeve 26 has a longitudinally extending opening 27, through which the rotation-preventing means 5 passes. This rotation-preventing means 5 secures the position of the roll shell 3 with respect to the central shaft 1. An annular space 6, which forms a coolant conduit, is provided between the support rings 4 of a support-ring sleeve 26 assigned to a roll shell 3, the inner lateral surface of the roll shell 3 and the outer lateral surface of the support-ring sleeve 26.

The strand-guiding roll is equipped with internal cooling. The flow of coolant is indicated by arrows in FIG. 3. The coolant is supplied on one end side of the strand-guiding roll via a rotary connection piece 10 and the coolant is discharged at the opposite end side (not shown) of the strand-guiding roll through a further rotary connection piece. The coolant is passed through a central coolant line 12, radial branch lines 13 which branch off from the central coolant line 12 and an annular groove 14 in the support ring 4 with axially oriented outlet openings 19 into a further annular groove 28 and, from there, is introduced through further radial branch lines 29, which pass through the support-ring sleeve 26 in the radial direction, into the annular space 6. The coolant, distributed over the entire cross section of the annular space 6, flows parallel to the longitudinal axis 15 of the strand-guiding roll through the annular space 6 and is passed, via radial branch lines 30 which pass radially through the support-ring sleeve 26, into an annular groove 31 and is collected again in an annular groove 16 of the support ring 4 and discharged through radial branch lines 17 into the central coolant line 18. The coolant line 18 leads either to further branch lines of a further roll shell or, after the coolant has passed through all the roll shells, to the discharging rotary connection piece, through which the coolant leaves the strand-guiding roll again.

The invention claimed is:

1. A strand-guiding roll for supporting and guiding cast metal strands in a continuous casting installation, the roll comprising:

a central rotatable shaft;

at least one roll shell supported on and fixed against rotation on the shaft;

support rings on the shaft supporting the roll shell;

the shaft, the roll shell and the support rings being shaped to define an annular space which is axially delimited by the support rings and is formed between the shaft and the roll shell; and connections to the annular space for the space to be a coolant conduit via the connections, the connections to the annular space comprising a coolant line arranged in and extending along a direction of an axis of the central shaft and radial branch lines from the coolant line, the coolant and branch lines being operable for supplying a coolant to and discharging the coolant from the annular space, wherein the support rings have respective annular grooves, the radial branch lines open out within a longitudinal extent of the support rings and into the annular grooves in the support rings, and the annular grooves in the support rings open toward the annular space, a multiplicity of outlet openings opening the annular grooves toward the space.

2. A strand-guiding roll for supporting and guiding cast metal strands in a continuous casting installation, the roll comprising:

a central rotatable shaft;

at least one roll shell supported on and fixed against rotation on the shaft;

support rings on the shaft supporting the roll shell;

the shaft, the roll shell and the support rings being shaped to define an annular space which is axially delimited by the support rings and is formed between the shaft and the roll shell; and connections to the annular space for the space to be a coolant conduit via the connections, wherein two of the support rings support the at least one roll shell on the shaft, the two support rings are connected to form a support-ring sleeve, and the annular space has an axial extent which is delimited by the support rings, the annular space being formed between the roll shell and the support-ring sleeve.

3. The strand-guiding roll as claimed in claim 2, further comprising sealing elements arranged between the support rings connected by the support-ring sleeve and the roll shell and between the support rings and the central shaft.

4. The strand-guiding roll as claimed in claim 3, wherein the support rings have respective annular grooves, and the sealing elements comprise sealing rings inserted in the annular grooves in the roll shell.

5. The strand-guiding roll as claimed in claim 2, further comprising the connections to the annular space comprising a coolant line arranged in and extending along a direction of an axis of the central shaft and radial branch lines from the coolant line, the coolant and branch lines being operable for supplying a coolant to and discharging the coolant from the annular space.

6. The strand-guiding roll as claimed in claim 2, further comprising a rotation-preventing device passing through the annular space and shaped to secure the roll shell against rotation with respect to the shaft.

7. A strand-guiding roll for supporting and guiding cast metal strands in a continuous casting installation, the roll comprising:

a central rotatable shaft;

at least one roll shell supported on and fixed against rotation on the shaft;

support rings on the shaft supporting the roll shell;

the shaft, the roll shell and the support rings being shaped to define an annular space which is axially delimited by the support rings and is formed between the shaft and the roll shell;

connections to the annular space for the space to be a coolant conduit via the connections; and sealing elements arranged between the support rings and the roll shell and between the support rings and the central shaft, wherein the support rings have respective annular grooves, and the sealing elements comprise sealing rings inserted in the annular grooves in the roll shell.

* * * * *